US005197647A

United States Patent [19]

Howell

[11] Patent Number: 5,197,647

[45] Date of Patent: Mar. 30, 1993

[54] FASTENER-DRIVING TOOL WITH IMPROVED FEEDING MECHANISM

[75] Inventor: Scott A. Howell, Crystal Lake, Ill.

[73] Assignee: Illinois Tool Works Inc., Glenview, Ill.

[21] Appl. No.: 779,892

[22] Filed: Oct. 21, 1991

[51] Int. Cl.[5] ..... B25C 1/00

[52] U.S. Cl. ..... 227/126; 227/125

[58] Field of Search ..... 227/126, 120, 125, 130

[56] References Cited

U.S. PATENT DOCUMENTS

| | | | |
|---|---|---|---|
| 1,996,640 | 4/1935 | Case | 227/126 |
| 2,522,931 | 9/1950 | Curtiss | 227/126 |
| 3,946,927 | 3/1976 | Fehrs | 227/126 |
| 4,319,706 | 3/1982 | Halstead | 227/126 |

FOREIGN PATENT DOCUMENTS

| | | | |
|---|---|---|---|
| 387211 | 9/1990 | European Pat. Off. | 227/126 |

*Primary Examiner*—Frank T. Yost

*Assistant Examiner*—Rinaldi Rada

*Attorney, Agent, or Firm*—Schwartz & Weinrieb

[57] ABSTRACT

A fastener-driving tool comprising a nosepiece, a mechanism for driving a fastener from the nosepiece into a workpiece, and a mechanism for feeding an elongate strip of collated fasteners, such as, for example, nails having heads. An elongate track admits the strip of fasteners and guides it so that a leading fastener is positioned so as to enter the nosepiece. A pusher is movable longitudinally along the track over a range of operative positions, between a retracted position and an advanced position, and laterally between the retraced position and an inoperative position. The pusher is biased longitudinally so as to push the strip of fasteners along the track, toward the advanced position, when the pusher is disposed within the range of operative positions. The pusher is biased laterally toward the inoperative position, at which it can be releasably latched. A button is arranged to be manually depressed so as to release the pusher.

15 Claims, 3 Drawing Sheets

FIG. 1
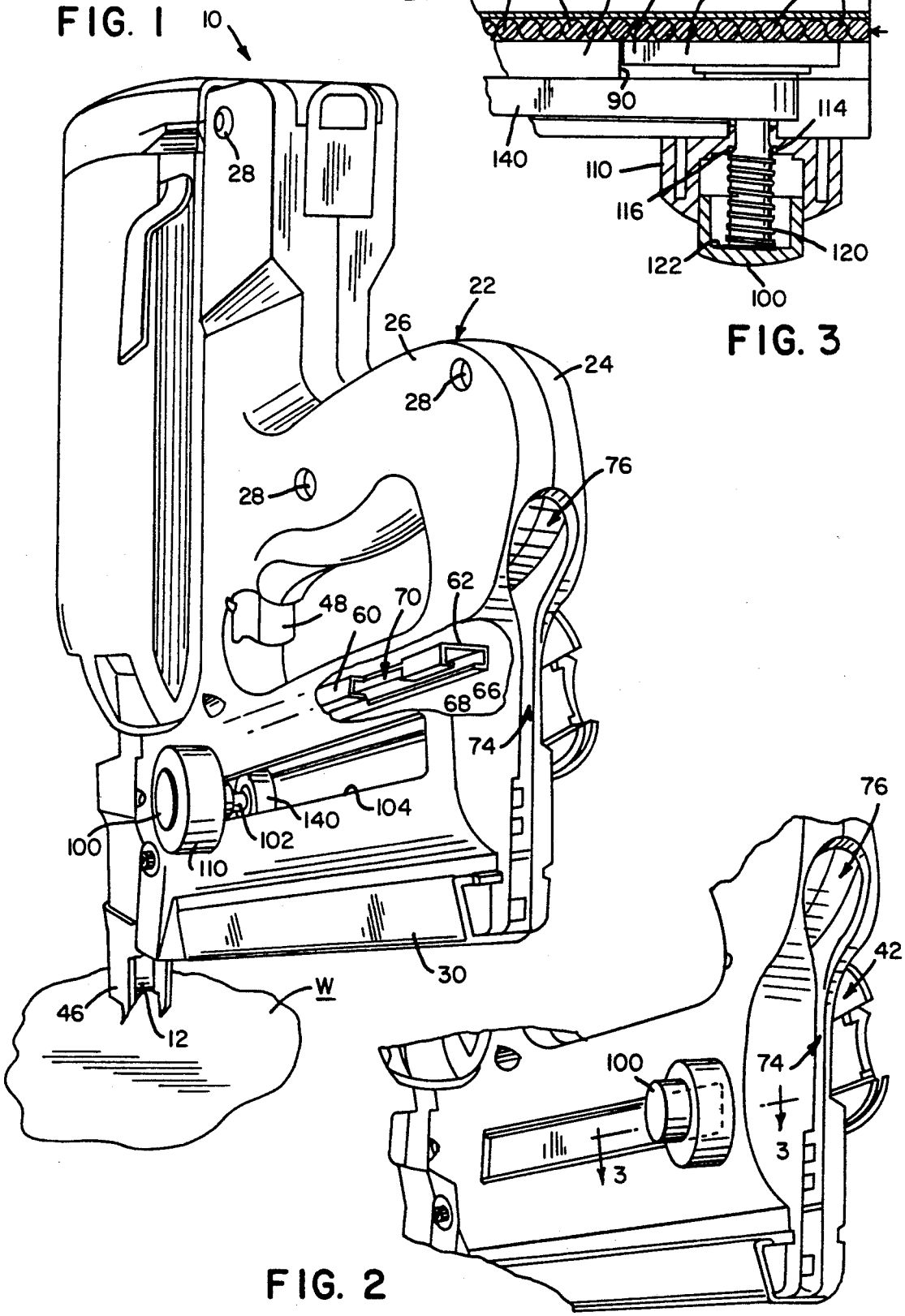
FIG. 2
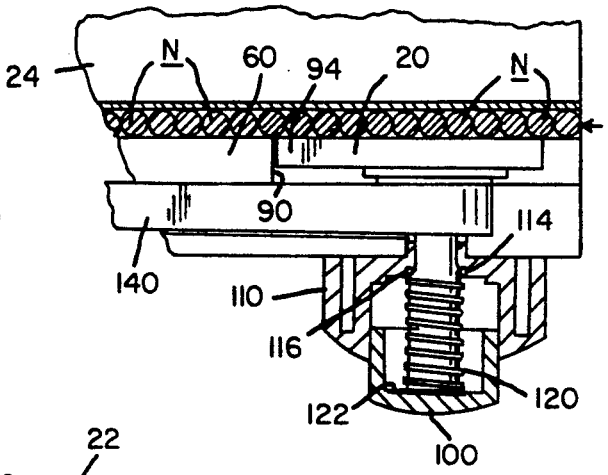
FIG. 3

FIG. 4
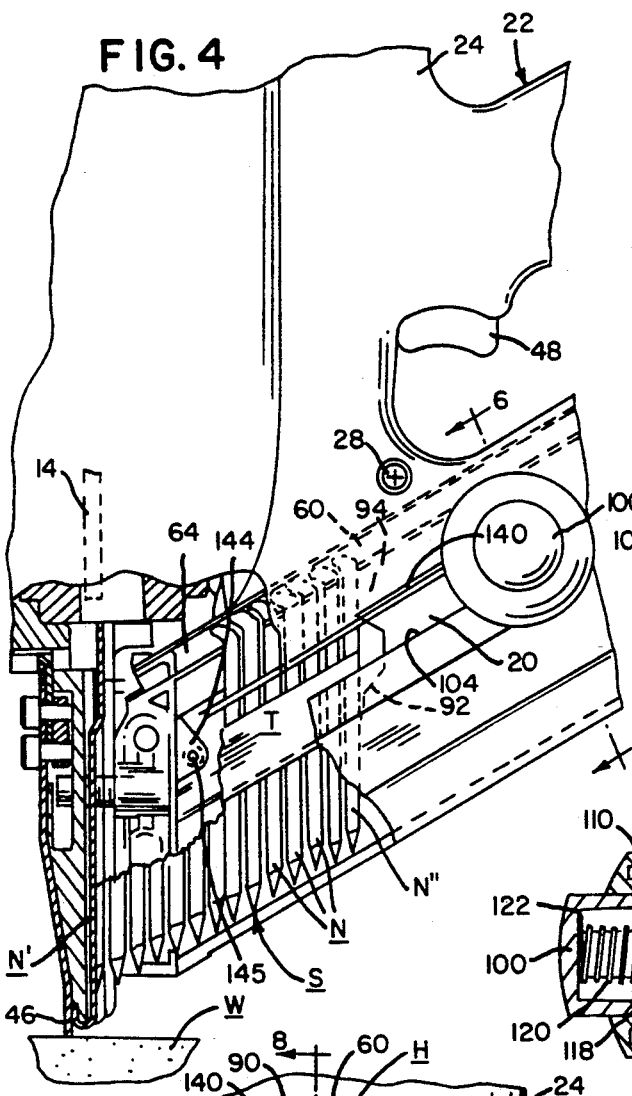
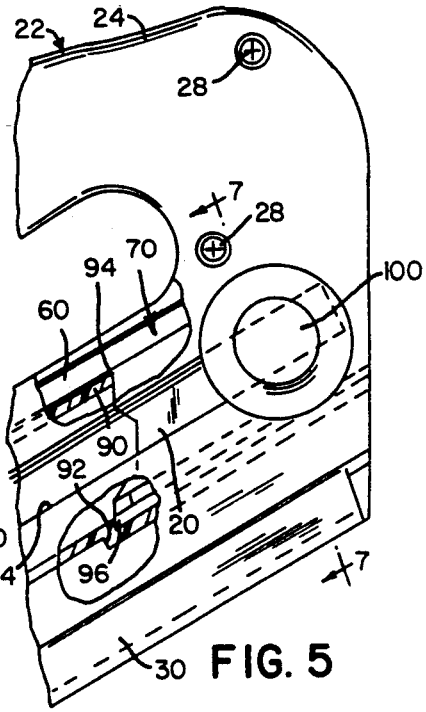
FIG. 5
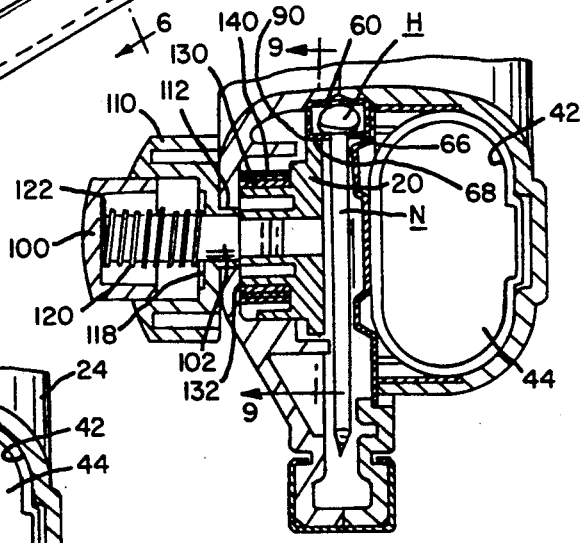
FIG. 7
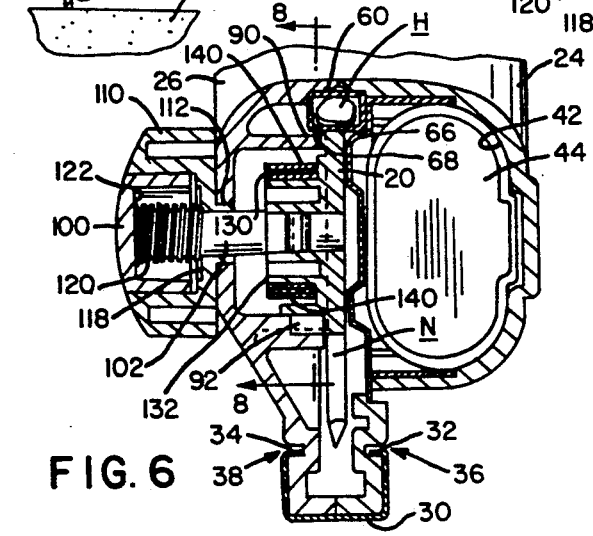
FIG. 6

FASTENER-DRIVING TOOL WITH IMPROVED FEEDING MECHANISM

TECHNICAL FIELD OF THE INVENTION

This invention pertains to a fastener-driving tool, such as, for example, a nail-driving tool, of the type comprising a nosepiece, a driving mechanism for driving a fastener from the nosepiece into a workpiece, and a mechanism for feeding an elongate strip of collated fasteners forwardly toward the nosepiece so that the fasteners are fed successively into the nosepiece. According to this invention, the feeding mechanism includes a pusher, which can be releasably latched in an inoperative position so as to facilitate loading such a strip of collated fasteners into the tool.

BACKGROUND OF THE INVENTION

Fastener-driving tools, such as, for example, nail-driving tools or staple-driving tools, may be pneumatically powered or combustion-powered tools. Pneumatically powered tools of the type noted above are exemplified in Howard et al. U.S. Pat. No. 4,629,106, Nikolich U.S. Pat. No. 4,549,344, Plunkett U.S. Pat. No. 4,188,858, and Howard U.S. Pat. No. 3,815,475. Combustion-powered tools of the type noted above are exemplified in Nikolich U.S. Pat. No. Re. 32,452, Nikolich U.S. Pat. No. 4,522,162, and No. 4,483,474, Wagdy U.S. Pat. No. 4,483,473, and Nikolich U.S. Pat. No. 4,403,722.

Typically, the feeding mechanism of such a tool employs a spring-biased pusher, which must be manually held in a retracted position while an elongate strip of collated fasteners is being loaded into the tool. Such manipulations can be somewhat difficult for a user needing to load such a strip of fasteners into the tool, particularly if the user is standing upon a ladder or is disposed in cramped quarters. It would be highly desirable to provide such a tool with an improved mechanism for feeding an elongate strip of collated fasteners so that there would be no need for a pusher to be manually held when such a strip of fasteners was being loaded into the tool.

SUMMARY OF THE INVENTION

This invention provides, in a fastener-driving tool of the type noted above, an improved mechanism for feeding an elongate strip of collated fasteners including a leading fastener and a trailing fastener in such a manner that the fasteners are fed successively into a nosepiece, from which the fasteners can then be driven into a workpiece by means of a driving mechanism. According to this invention, the feeding mechanism includes a pusher, which can be releasably latched in an operative position so as to facilitate loading such a strip of collated fasteners into the tool.

Along with the pusher, the feeding mechanism comprises an elongate track and several biasing and latching structures. The elongate track has an inlet end and an outlet end, which communicates with the nosepiece. The track admits such a strip of fasteners into the inlet end with the leading fastener preceding the trailing fastener and guides the strip of fasteners along the track in such a manner that the leading fastener is positioned to enter the nosepiece from the outlet end. In a preferred embodiment, which is used with an elongate strip of collated nails, the track has two laterally spaced, inwardly turned flanges, from which the strip of nail fasteners is suspended by means of the nail heads.

The pusher is adapted to move longitudinally along the track over a range of operative positions including a retracted position and an advanced position. In addition, the pusher is adapted to move laterally between the retracted position and an inoperative position, at which the pusher is displaced so as to permit such a strip of the fasteners to then be admitted into the inlet end of the elongate track. The pusher is used for pushing the strip of fasteners along the track when the pusher is disposed at one of the operative positions defined within the range of operative positions. Various means are provided respectively for biasing the pusher longitudinally toward the advanced position, for biasing the pusher laterally toward the inoperative position, and for releasably latching the pusher at the inoperative position.

In the preferred embodiment, the latching means comprises two vertically spaced edges disposed in a fixed relationship with respect to the track. When the pusher is disposed at the inoperative position, these edges are disposed so as to engage the pusher, so as to prevent the pusher from moving longitudinally toward the advanced position.

Furthermore, in accordance with the preferred embodiment, the latching means comprises a button having a stem fixedly mounted upon the pusher so as to extend laterally for the pusher. The bottom is adapted to be manually depressed so as to disengage the pusher from the edges and to move the pusher laterally from the inoperative position into the retracted position. The button is longitudinally movable with the pusher when the pusher is disposed at one of the operative positions defined within the range of operative positions.

Moreover, in accordance with the preferred embodiment, the latching means comprises a sleeve mounted around the button so as to permit lateral movement of the button and the pusher relative to the sleeve. The sleeve is mounted in a movable relationship with respect to the elongate track so as to be longitudinally movable with the button and the pusher.

Preferably, the means for biasing the pusher laterally toward the inoperative position comprises a coiled spring operatively mounted between the sleeve and the button and longitudinally movable with the button, the sleeve, and the pusher. Preferably, the means for biasing the pusher longitudinally toward the advanced position comprises a negator spring having a forward end and a rearward end. The forward end is mounted in a fixed relationship with respect to the elongate track. The rearward end is operatively mounted upon the pusher.

BRIEF DESCRIPTION OF THE DRAWINGS

These and other objects, features, and advantages of this invention will become evident from the following description of a preferred embodiment of this invention with reference to the accompanying drawings, in which like reference characters designate like or corresponding parts throughout the several views, and wherein:

FIG. 1 is a perspective view of a combustion-powered, nail-driving tool comprising an improved mechanism for feeding an elongate strip of collated nails having heads. Certain elements of the improved mechanism are shown in an advanced, operative position.

FIG. 2 is a fragmentary, perspective view showing the same elements in a retracted, inoperative position.

FIG. 3 is a fragmentary, sectional view taken along line 3—3 of FIG. 2, in a direction indicated by means of the arrows.

FIG. 4, on a larger scale, is a fragmentary, partly broken away, elevational view showing the aforenoted elements in an intermediate, operative position.

FIG. 5, on the same scale, is a fragmentary, partly broken away, elevational view showing the same elements in the retracted, inoperative position.

FIG. 6 is a fragmentary, sectional view taken along line 6—6 of FIG. 4, in a direction indicated by means of the arrows.

FIG. 7 is a fragmentary, sectional view taken along line 7—7 of FIG. 5, in a direction indicated by means of the arrows.

FIG. 8 is a fragmentary, sectional view taken along line 8—8 of

FIG. 6, in a direction indicated by means of the arrows.

DETAILED DESCRIPTION OF PREFERRED EMBODIMENT

Figure 8:
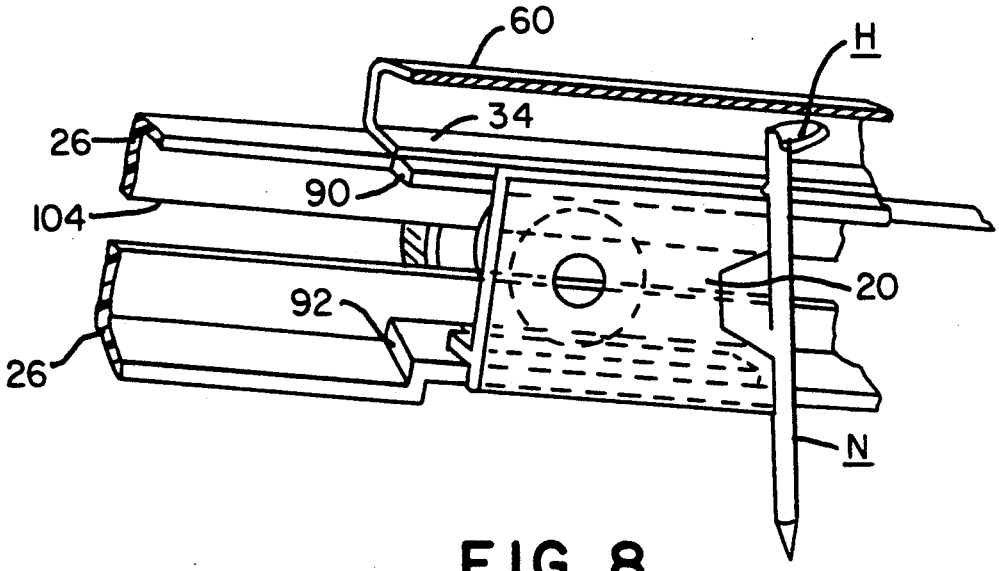
Figure 9:
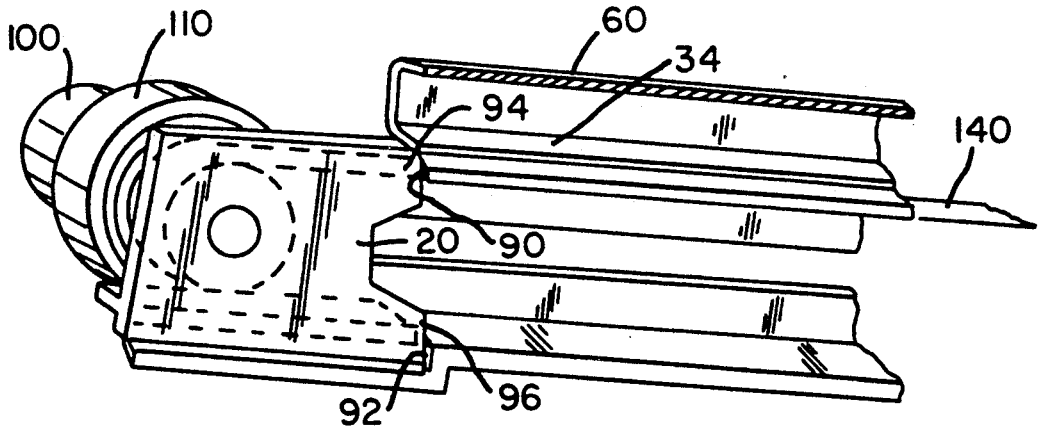
FIG. 9 is a fragmentary, sectional view taken along line 9—9 of FIG. 7, in a direction indicated by means of the arrows.

As shown in the drawings, a combustion-powered, nail-driving tool 10 constitutes a preferred embodiment of this invention. Broadly, the tool 10 comprises a nosepiece 12, a mechanism including a driver 14, as shown in FIG. 4, for driving a nail from the nosepiece 12 into a workpiece W when the tool 10 is actuated, and an improved mechanism for feeding an elongate strip S of nails N, as also seen in FIG. 4, in such a manner that the nails N are successively fed into the nosepiece 12. As shown, the nails N are collated in a known manner by means of collating tapes T and have D-shaped heads H, as best seen in FIG. 8. The nails N of the strip S include a leading nail N' and a trailing nail N''. According to this invention, the feeding mechanism comprises a pusher 20, which can be releasably latched in an inoperative position so as to facilitate loading such a strip of collated nails into the tool.

The tool 10 has a housing and a handle structure 22 comprising two housing and handle pieces 24, 26, which are assembled together by means of screws 28 and by means of a metal channel 30 having two inwardly turned flanges 32, 34, that fit into grooves 36, 38 defined within the respective pieces 24, 26, as best seen in FIG. 6. These pieces 24, 26, may be advantageously molded from an engineering polymer. The piece 24 has a socket 42, as seen in FIGS. 6 and 7, accommodating a battery pack 44, which powers an ignition system (not shown) of the tool 10. The tool has switches (not shown) including a head switch, which is actuatable by means of a workpiece-contacting element 46, as seen in FIGS. 1 AND 4, and a trigger switch, which is actuatable by means of a manually actuatable trigger 48.

An elongate track 60, which is made from a metal extrusion, is fixedly mounted within the housing and handle structure 22. The track 60 has an inlet end 62 and an outlet end 64, as seen in FIG. 4, which communicates with the nosepiece 12. The track 60 has two laterally spaced, inwardly turned flanges 66, 68. Near the inlet end 62, the track 60 has a lateral slot 70 defined within a sidewall portion of the track 60.

The housing and handle structure 22 has an elongate, vertically extending slot 74, which is enlarged at an upper, rear portion 76. The slot 74 is shaped so as to permit the strip S of collated nails N to be endwise inserted through the slot 74, into the inlet end 62 of the track 60, with the leading nail N' preceding the trailing nail N''. The enlarged portion 76 of the slot 74 accommodates the nail heads H. When admitted into the inlet end 62 of the track 60, the strip S is suspended from the flanges 66, 68 by means of the nail heads H and is guided along the track 60 in such a manner that the leading nail N' is positioned to enter the nosepiece 12 from the outlet end 64 of the track 60.

The pusher 20 is disposed within the slot 74 and is adapted to move longitudinally through the slot 74, along the track 60, over a range of operative positions including a retracted position and an advanced position. The upper end of the pusher 20 extends between the track flanges 66, 68. Thus, the pusher 20 is adapted to move longitudinally between the retracted and advanced positions, which are operative positions of the pusher 20. Also, the lateral slot 70 defined within the side wall portion of the track 60 permits the pusher 20 to move laterally between the retracted position and an inoperative position, at which the pusher 20 is laterally displaced so as to permit the strip S of collated nails N to be admitted into the inlet end 62 of the track 60. When the strip S is so admitted thereinto, the strip S can then be moved along the track 60 until the leading nail N' reaches a similar strip (not shown) previously admitted or inserted onto the track 60 until the leading nail N'' reaches the nosepiece 12, as shown in FIG. 4. However, when the pusher 20 is disposed at a position which is within the range of operative positions, the pusher 20 prevents such a strip from moving inwardly or outwardly past the pusher 20.

As explained below, the pusher 20 is biased longitudinally toward the advanced position. Thus, when the pusher 20 is disposed at a position which is within the range of operative positions, the pusher 20 is biased so as to engage the trailing nail N'' of the strip S so as to push the strip S along the track 60, toward the advanced position. As explained below, the pusher 20 is also biased laterally toward the inoperative position. Thus, when the pusher 20 is disposed at the retraced position, the pusher 20 moves laterally from the retracted position, as permitted by means of the track slot 70, into the operative position.

A latching means is provided, which releasably latches the pusher 20 at the inoperative position. The latching means comprises two vertically spaced, rearwardly facing edges 90, 92, which are defined by means of the housing and handle piece 26 as best seen in FIG. 8. The edges 90, 92, are disposed in a fixed relationship with respect to the track 60. As shown in FIGS. 4 and 7, when the pusher 20 is disposed at the inoperative position, the edges 90, 92, are disposed so as to engage the pusher 20 so as to prevent the pusher 20 from moving longitudinally toward the advanced position. As shown therein, the edge 90 engages an upper portion 94 of the pusher 20, and the edge 92 engages a lower portion 96 of the pusher 20.

Continuing further, the latching means comprises a button 100 having a stem 102, which is integral with the button 100, and which is fixedly mounted upon the pusher 20 so as to extend laterally from the pusher 20. The button 100 and the stem 102 may be advantageously molded, in one piece, from an engineering polymer. The stem 102 extends through an elongate slot 104 defined within the housing and handle piece 26 without any binding occurring between the stem 102 and such piece 26. The button 100 is adapted to be manually depressed so as to disengage the pusher 20 from the edges 90, 92, and so as to move the pusher 20 laterally from the inoperative position into the retracted position, which is an operative position of the pusher 20. Thus, when the pusher 20 is disposed at any one of the operative positions defined within the range of operative positions, the button is movable longitudinally with the pusher 20.

Moreover, the latching means comprises a sleeve 110, which is mounted around the button 100 so as to permit lateral movement of the button 100 and the pusher 20 relative to the sleeve 110. The sleeve 110 has a non-circular hub 112, as best seen in FIGS. 6 and 7, through which the stem 102 extends, and which extends through the elongate slot 104 so as to permit longitudinal movement of the sleeve 110 relative to the housing and handle piece 26. Thus, the sleeve 110 is mounted in a movable relationship with respect to the elongate track 60 so as to be longitudinally movable with the button 100 and the pusher 20.

A coiled spring 120 is disposed around the stem 102 of the button 100, so as to be axially compressed between an outer, annular surface 118 of the sleeve 100 and an inner, annular surface 122 of the button 100, also as best seen in FIGS. 6 AND 7. The spring 120 biases the button 100 so as to bias the pusher 20 laterally toward the inoperative position. Thus, when the pusher 20 is disposed at the retraced position, the spring 120 moves the pusher 20 into the inoperative position, at which the pusher 20 is releasably latched, unless and until the button 100 is depressed so as to move the pusher 20 laterally inwardly so as to permit the pusher 20 to move longitudinally along the elongate track 60 toward the advanced position.

As shown in FIGS. 6 and 7, a tubular element 130 is mounted in concentric relationship with respect to the stem 102 of the button 100, around an annular shoulder 132 formed integrally upon the pusher 20. The tubular element 130 may be advantageously molded from an engineering polymer. As best shown in FIG. 4, a negator spring 140 is provided which biases the pusher 20 toward the advanced position. The spring 140 has a forward end 144, which is fixedly mounted to the housing and handle structure 22, near the nosepiece 12, by means of a pin 145. The rearward end of the spring 140 is operatively connected to the pusher 20 as a result of being affixed to the tubular element 130 in such a manner that the spring 140 tends to wind around the tubular element 130 as the pusher 20 moves longitudinally toward the advanced position and to unwind as the pusher 20 moves in the opposite direction. The spring 140 can flex sufficiently in lateral directions so as to accommodate lateral movement of the pusher 20 between the retracted and inoperative positions.

The improved mechanism according to this invention is not restricted in its applicability to a nail-driving tool or to a combustion-powered tool. It is contemplated that such a mechanism may be readily adapted to a pneumatically powered, nail-driving tool or to a staple-driving tool, which may be pneumatically powered to combustion-powered.

Various modifications may be made in the preferred embodiment described above without departing from the scope and spirit of this invention. It is therefore to be understood that within the scope of the appended claims, the present invention may be practiced otherwise than as specifically described herein.

I claim:

1. A fastener-driving tool comprising a housing, a nose-piece, means for driving a fastener from said nosepiece into a workpiece, and means for feeding an elongate strip of collated fasteners, including a leading fastener and a trailing fastener, in such a manner that said fasteners are successively fed into said nosepiece, said feeding means comprising:

means comprising an elongate tract, having an inlet end, and an outlet end which communicates with said nose-piece, for admitting said elongate strip of fasteners into said inlet end with said leading fastener preceding said trailing fastener and for guiding said elongate strip of fasteners along said elongate track in such a manner that said leading fastener is positioned so as to enter said nosepiece from said outlet end of said track;

pusher assembly means comprising a support member longitudinally movable upon said housing; and a pusher member which is longitudinally movable along said elongate track over a range of operative positions, including a retracted position and an advanced position, for pushing said elongate strip of fasteners longitudinally along said elongate track when said pusher member is disposed within said range of operative positions, and which is laterally movable relative to said support member of said pusher assembly means between said retracted position and an inoperative position at which said pusher member is laterally displaced with respect to said support member of said pusher assembly means so as to permit said elongate strip of fasteners to be admitted into said inlet end of said elongate track;

means for biasing said pusher member longitudinally toward said advanced position;

biasing means mounted upon said pusher assembly means for biasing said pusher member, relative to said support member of said pusher assembly means, laterally toward said inoperative position; and means for relasably latching said pusher member at the inoperative position.

2. The fastener-driving tool of claim 1 wherein the latching means includes an edge disposed in fixed relation to the elongate track and disposed to engage the pusher member so as to prevent the pusher member from moving longitudinally toward the advanced position when the pusher member is in the inoperative position.

3. The fastener-driving tool of claim 2 wherein the latching means includes a button mounted fixedly to the pusher member and extended laterally from the pusher member, the button being adapted to be manually depressed to disengage the pusher member from the edge and to move the pusher member laterally from the inoperative position into the retracted position, the button being moveable longitudinally with the pusher member when the pusher member is in the range of operative positions.

4. The fastener-driving tool of claim 1 wherein the latching means includes two vertically spaced edges disposed in fixed relation to the elongate track, the edges being adapted respectively to engage the pusher member so as to prevent the pusher member from moving longitudinally toward the advanced position when the pusher member is in the inoperative position.

5. The fastener-driving tool of claim 4 wherein the latching means includes a button having a stem mounted fixedly to the pusher member and extended laterally from the pusher member and extended laterally from the pusher member the button being and extended be manually depressed to disengage the pusher member from the edges and to move the pusher member laterally from the inoperative position into the retracted position, the button being moveable longitudinally with the pusher member when the pusher member is in the range of operative positions. button being moveable longitudinally with the pusher member when the pusher member is in the range of operative positions.

6. The fastener-driving tool of claim 5 wherein said support member comprises a sleeve mounted around the button so as to permit lateral movement of the button and the pusher member relative to the sleeve, the sleeve being mounted in moveable relation to the elongate track so as to be longitudinally moveable with the button and the pusher member.

7. The fastener-driving tool of claim 6 wherein the means for biasing the pusher member laterally toward the inoperative position includes a coiled spring mounted operatively between the sleeve and the button and moveable longitudinally with the button, the sleeve, and the pusher member.

8. The fastener-driving tool of claim 5 wherein the means for biasing the pusher member longitudinally toward the advanced position includes a negator spring having a forward end and a rearward end, the forward end being mounted in fixed relation to the elongate track, the rearward end being mounted operatively to the pusher member.

9. A nail-driving tool comprising a housing, a nosepiece, means for driving a nail from said nosepiece into a workpiece, and means for feeding an elongate strip of collated nails, having heads and including a leading nail and a trailing nail, in such a manner that said nails are successively fed into said nosepiece, said feeding means comprising:

means comprising an elongate track, having two laterally spaced, inwardly turned flanges, an inlet end, and an outlet end, which communicates with said nosepiece, for admitting said elongate strip of nails into said inlet end of said track with said leading nail preceding said trailing nail, for suspending said elongate strip of nails from said flanges by said nail heads, and for guiding said elongate strip of nails along said elongate track in such a manner that said leading nail is positioned so as to enter said nosepiece from said outlet end of said track;

pusher assembly means comprising a support member longitudinally movable along said housing; and a pusher member which is longitudinally movable along said elongate track over a range of operative positions, including a retracted position and an advanced position, for pushing said elongate strip of nails longitudinally along said elongate track when said pusher member is disposed within said range of operative positions, and which is laterally movable relative to said support member of said pusher assembly means between said retracted position and an inoperative position at which said pusher member is laterally displaced with respect to said support member of said pusher assembly means so as to permit said elongate strip of nails to be admitted into said inlet end of said elongate track;

means for biasing said pusher member longitudinally toward said advanced position;

biasing means mounted upon said pusher assembly means for biasing said pusher member, relative to said support member of said pusher assembly means, laterally toward said inoperative position; and means for releasably latching said pusher member at said inoperative position.

10. The nail-driving tool of claim 9 wherein the latching means includes at least one edge being in fixed relation to the elongate track, the edge being disposed to engage the pusher member so as to prevent the pusher member from moving longitudinally toward the advanced position when the pusher member is in the inoperative position.

11. The nail-driving tool of claim 10 wherein the latching means includes a button having a stem mounted fixedly to the pusher member so as to extend laterally from the pusher member the button being adapted to be manually depressed to disengage the pusher member from the edge and to move the pusher member laterally from the inoperative position into the retracted position, the button being moveable longitudinally with the pusher member when the pusher member is in the range of operative positions.

12. The nail-driving tool of claim 11 wherein said support member comprises a sleeve mounted around the button so as to permit lateral movement of the button and the pusher member relative to the sleeve, the sleeve being mounted in moveable relation to the elongate track so as to be longitudinally moveable with the button and the pusher member.

13. The nail-driving tool of claim 12 wherein the means for biasing the pusher member laterally toward the inoperative position includes a coiled spring mounted operatively between the sleeve and the button and moveable longitudinally with the button, the sleeve, and the pusher member.

14. The nail-driving tool of claim 13 wherein the means for biasing the pusher member longitudinally toward the advanced position includes a negator spring having a forward end and a rearward end, the forward end being mounted in fixed relation to the elongate track, the rearward end being mounted operatively to the pusher member.

15. The nail-driving tool as set forth in claim 10, wherein:

said at least one edge of said latching means comprises a pair of vertically spaced edges for engaging said pusher member so as to prevent said pusher member from moving longitudinally toward said advanced position when said pusher member is disposed at said inoperative position.

* * * * *